US005605500A

United States Patent [19]

Matechuk

[11] Patent Number: 5,605,500

[45] Date of Patent: Feb. 25, 1997

[54] VACUUM ATTACHMENT ASSEMBLIES FOR SANDING TOOLS

[76] Inventor: William Matechuk, Apt. 314, 20 Bradman Avenue, St. Catharines, Ontario, Canada, L2M 3S5

[21] Appl. No.: 558,646

[22] Filed: Nov. 16, 1995

[51] Int. Cl.[6] ..... B24B 55/10

[52] U.S. Cl. ..... 451/456; 451/344; 451/354

[58] Field of Search ..... 451/456, 344, 451/354

[56] References Cited

U.S. PATENT DOCUMENTS

| | | | |
|---|---|---|---|
| 4,697,389 | 10/1987 | Romine | 451/354 |
| 5,193,313 | 3/1993 | Sanchez et al. | 451/344 |
| 5,245,797 | 9/1993 | Milkie | 451/354 |
| 5,283,988 | 2/1994 | Brown | 451/354 |
| 5,470,272 | 11/1995 | Kikuchi et al. | 451/344 |

*Primary Examiner*—Willis Little
*Assistant Examiner*—Eileen P. Morgan
*Attorney, Agent, or Firm*—McConnell and Fox

[57] ABSTRACT

A vacuum attachment assembly is provided for use in combination with a corner sanding tool comprising a replaceable sander block of resilient foam material having a transverse cross section of the form of an isosceles triangle. The block is removably mounted on a carrier member which is inserted into a close-fitting chamber within the block body through a narrow entrance passage, the carrier being connected to a handle. The vacuum attachment comprises a C-shaped body having two parallel end portions extending from a central portion, and the sander block is of sufficient length that it must be compressed somewhat longitudinally for it to be inserted into the assembly, which is thereby frictionally retained under the resilience of the sander block body material. The attachment central portion has two parallel side walls which are butted by the resilient sander block to establish an air-tight, air-receiving plenum chamber between the attachment member and the sander block. The end portions have air flow passages connecting their free edges with the plenum chamber interior through which the air and entrained dust pass. An opening from the plenum chamber for the air also has a handle passing through to the carrier member. Preferably, the handle is surrounded by a flexible bellows forming part of the air passage, the remainder being constituted by the handle, which is hollow.

14 Claims, 2 Drawing Sheets

VACUUM ATTACHMENT ASSEMBLIES FOR SANDING TOOLS

FIELD OF THE INVENTION

This invention is concerned with vacuum attachment assemblies for use with sanding tools, and especially with vacuum attachment assemblies for hand sanding tools intended, for example, for dry wall sanding, where the tool is required to sand uniformly in corners at the intersection of two room surfaces.

DESCRIPTION OF THE PRIOR ART

There is described and claimed in my U.S. Pat. No. 4,825,597, issued 2nd May, 1989, the disclosure of which is incorporated herein by this reference, a hand sanding tool for sanding corner joints, such as are encountered most commonly in dry wall construction between adjoining walls and between the walls and the ceiling. The tool comprises a replaceable resilient foam block having a transverse cross section that is a right angled isosceles triangle, the two equal side surfaces being the sanding sides and being coated with abrasive material. The block has a chamber therein shaped to snugly receive a carrier for the foam block, the carrier also having a cross section that is an isosceles triangle, so that equal sanding pressures are applied to the abrasive coated sanding block sides. The carrier triangle apex angle is smaller than that of the block, resulting in a maximum sanding force into the corner and a progressive feathering reduction of the force away from the corner. The carrier has a handle pivotally connected thereto by which the tool is manipulated, the handle being connected to the carrier by a rod that passes through a narrow vertically elongated opening in the larger hypotenuse side of the block. The handle is adapted to receive an elongated extension to facilitate sanding into corners above shoulder height.

This tool has been successful and is sold commercially but, as is common with sanding tools, there is increasingly a requirement for a vacuum attachment to remove immediately as much as possible of the dust resulting from the sanding operation. The provision of such an attachment for these tools has been found to be unexpectedly difficult, owing for example for the need to ensure that the tool sanding surfaces remain unobstructed and the surfaces being sanded are not fouled. It is also important that the attachment is as lightweight as possible, in view of the fact that it is attached to a tool that is usually hand operated, and is used for an appreciable proportion of its total working time above shoulder level, involving considerable physical effort on the part of the operator.

SUMMARY OF THE INVENTION

It is a principal object of the present invention to provide a vacuum attachment assembly especially suited for use with a hand operated corner joint sanding tool.

It is another object to provide such an assembly that is light in weight.

It is a further object to provide such an assembly that permits ready replacement of the abrasive coated sanding block when required.

In accordance with the present invention there is provided a vacuum attachment assembly for use in combination with a corner sanding tool, the tool comprising:

a replaceable sander block of resilient foam material having a transverse cross section of the form of an isosceles triangle, and handle means attachable to and detachable from the sander block for its manipulation to carry out a sanding operation;

the sander block having two end surfaces of correspondingly isosceles triangular shape, two equal rectangular sanding side surfaces coated with abrasive material, and a rectangular hypotenuse side surface;

the handle means comprising a carrier member having a transverse cross section of the form of an isosceles triangle and a handle pivotally connected to the carrier member;

the sander block having a chamber therein opening to the hypotenuse side surface and shaped to snugly receive the carrier member;

the vacuum attachment comprising an attachment body that is C-shaped in side elevation, having a central portion and two parallel end portions each extending from a respective end of the central portion;

the length of the central portion being such that with a sander block in position in the assembly the end portions and the block end surfaces are sufficiently engaged with one another to retain the attachment body securely on the block;

the central portion having two parallel side walls extending between the two end portions which are butted by the hypotenuse surface of a sander block in position in the attachment body to thereby establish an air-receiving plenum chamber between the side walls, the central portion and the block hypotenuse surface;

the end portions having respective connected edges at their junctions with the central portion and side walls, and at least portions of the remainder of their edges being free edges adjacent to sander block sanding surfaces;

the attachment body end portions being of smaller area than the respective sander block end surfaces which they engage, so that the end surfaces protrude beyond the respective free edges of the end portions;

the end portions having therein air flow passages connecting the free edges with the plenum chamber interior, whereby air flow through the passages can entrain dust produced by sanding adjacent the end portion free edges and convey it into the plenum chamber interior;

the central portion having therein at least one opening from the plenum chamber to permit passage therefrom of air and entrained dust, and to permit extension of the handle through the attachment body to the carrier member.

Preferably the attachment body end portions are of triangular shape in plan and their free edges are uniformly spaced from the corresponding sander block edges. Each attachment body end portion may have a plurality of parallel air passages extending from its free edges to the plenum chamber interior.

Preferably, the handle is hollow and constitutes at least part of the passage through which the air and entrained dust passes from the plenum chamber, the attachment body central portion has a single opening therein through which both the handle and the air passage extend; and the assembly comprises a flexible air-tight sleeve surrounding the handle into which the opening discharges and through which the handle passes, the air passing from the interior of the sleeve into the portion of the air passage within the handle. In such an embodiment a spherical mechanical joint is provided between the handle and the flexible sleeve.

The butting surfaces of the attachment body end portions and the block end surfaces may have friction sheet material interposed between them to increase the retaining friction between them.

DESCRIPTION OF THE DRAWINGS

Vacuum attachment assemblies for a hand sanding tool that are particular preferred embodiments of the invention will now be described, by way of example, with reference to the accompanying diagrammatic drawings, wherein.

DESCRIPTION OF THE PREFERRED EMBODIMENTS

Figures 1, 4:
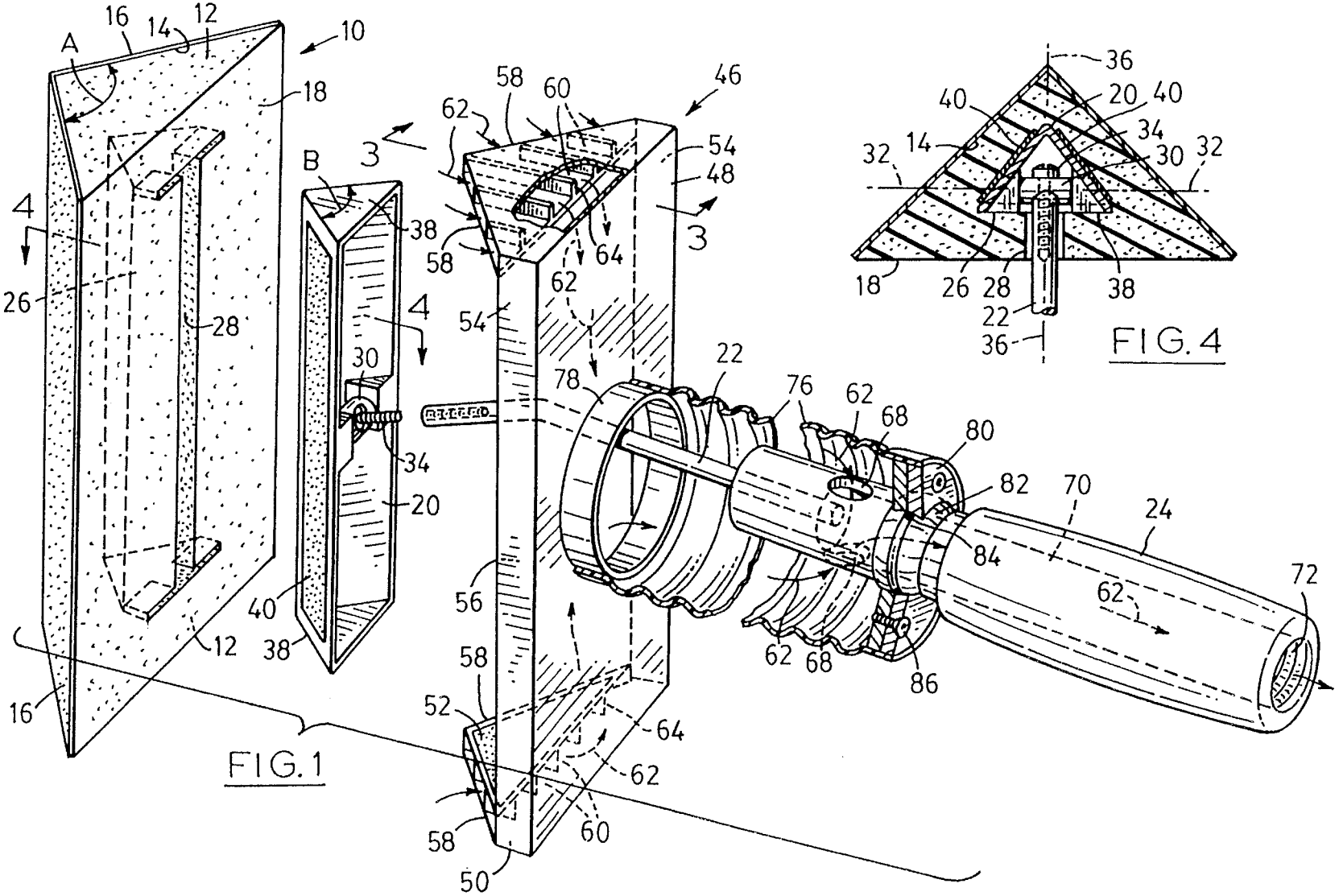
FIG. 1 is an exploded perspective view with parts cut away where necessary for clarity of illustration, showing a vacuum attachment assembly which is a first embodiment of the invention, in combination with a hand sanding tool as described and claimed in my U.S. Pat. No. 4,825,597.
FIG. 4 is a partial horizontal cross section taken on the line 4—4 in FIG. 1, but with the carrier member of the handle means shown inserted into the chamber therefor in the interior of the sanding block.

A preferred embodiment of my hand corner sanding tool comprises a replaceable sanding block 10 of firm but resilient foam material having a transverse cross section in the form of a right angle isosceles triangle, so that its apex angle A has a value of 90 degrees, enabling the tool to sand into right angled corners. A block intended for a corner with a different angle of incidence of the walls forming the corner will have a corresponding apex angle. The block has two end surfaces 12 of correspondingly right angle isosceles triangular shape and two equal rectangular side surfaces 14, the latter having sheets 16 of abrasive surfaced material attached thereto, as by an adhesive. Handle means onto which a block 10 can readily be securely mounted, and from which it can readily be removed when the sanding surfaces become too worn, comprise a carrier member 20, a connecting rod 22, and a handle 24 connected by the rod 22 to the carrier member. The carrier member also has a transverse cross section in the form of an isosceles triangle, and is inserted into a chamber 26 of the same size and cross section in the interior of the block through a centrally located narrow vertically elongated rectangular passage 28 opening to rectangular hypotenuse side surface 18. The wider carrier member must be forced through the passage 28 against the resilience of the block material, which closes around the member to retain it securely therein with the rod extending freely through the passage.

Figure 3:
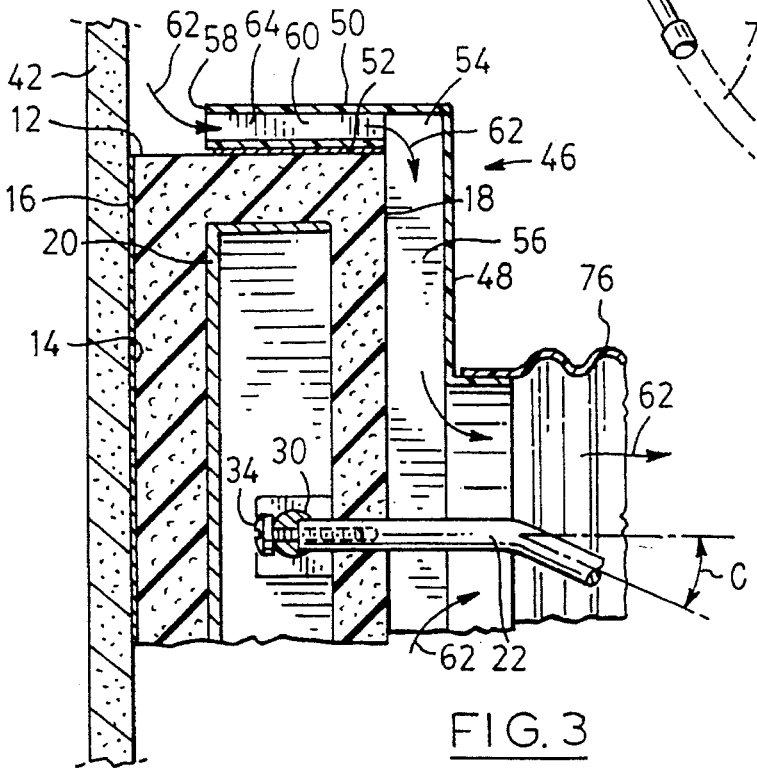
FIG. 3 is a partial vertical cross section taken on the line 3—3 in FIG. 1.

In this embodiment the carrier member is a hollow metal casting of apex angle B (FIG. 1) somewhat smaller than a right angle, usually about 60–70 degrees, so that, as explained in my prior patent, the sanding force is concentrated toward the apex of the sanding block, while the force reduces progressively from the block apex to its rear corners in order to produce a suitable feathering of the sanding. The necessary freedom of movement of the carrier member and the block relative to the handle 24 is provided by a two-axis universal joint between the rod 22 and the carrier member 20. This joint consists of an axle 30 mounted in the carrier member for free rotation about an axis 32 (FIG. 4) extending parallel to the block end faces 12, while a screw 34 connecting the axle 30 to the rod 26 constitutes another axle that permits rotation about an axis 36 disposed at a right angle to the axis 32 and passing through the apices of the sander block and the carrier member. The connecting rod 26 is cranked or bent close to its point of attachment with the carrier member at an angle C (FIG. 3), which in this embodiment is about 60 degrees. As is explained in more detail in my prior patent, this bending of the connecting rod in this location close to the carrier member ensures that the forces caused by the friction between the sanding block and the sanded surfaces are not transverse to the handle but are primarily longitudinal, so as to minimize vibration and bending of the handle (and of any extension attached to the handle) that could result in non-uniform sanding and undesirable appearance of the sanded area. The two equal rectangular faces 38 of the carrier member each have a sheet 40 of abrasive material attached thereto, as by an adhesive, to increase the friction between the carrier member and the block internal surfaces which it butts against so as to increase the security of retention of the block on the carrier member.

Figure 2:
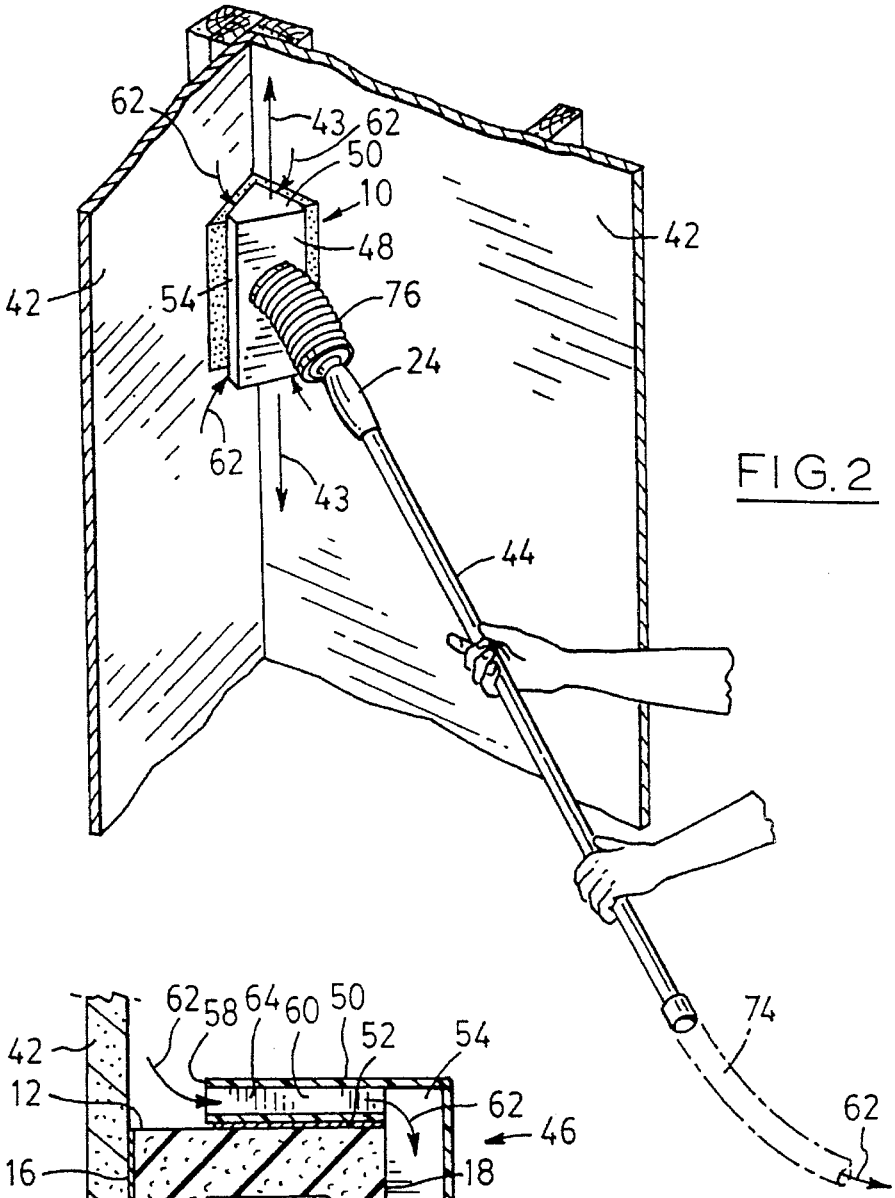
FIG. 2 is a perspective view showing a vertical corner formed between two adjoining drywall construction walls, and illustrating the mode of operation of the combination of a hand sanding tool with a vacuum attachment assembly of the invention.

It will be seen that with such a hand tool there is considerable difficulty in providing a vacuum attachment assembly that is close to the sanding surfaces without the possibility of unwanted contact with the surfaces being sanded, and that is sufficiently compact and lightweight as not to hinder effective operation of the tool. FIG. 2 shows the tool in combination with a vacuum attachment assembly of the invention in use in the sanding of a right angle vertical corner between two drywall room walls 42, requiring vertical movement of the tool in the directions of the arrows 43, the handle 24 being provided with an extension 44 to permit ready use of the tool above shoulder height.

The assembly comprises an attachment body 46 that conveniently is described as being C-shaped in side elevation, the body having a rectangular elongated central portion 48 and two parallel end portions 50 each extending at a right angle from a respective end of the central portion. The length of the central portion is such that with a sander block 10 in position in the body the end portions 50 and the block end surfaces 12 are sufficiently engaged with one another to retain the attachment body securely on the block. Thus, advantage is taken of the firm resilient nature of the material of the sander block for the block to also serve as means for retaining the assembly in position thereon, the space between the end portions 50 being sufficiently shorter than the uncompressed block that it must be compressed longitudinally for it to be inserted between them, the resultant frictional engagement under the pressure caused by the block's resilience ensuring that a secure connection is achieved. The friction of the engagement is increased by interposing sheets 52 of abrasive material between the contacting surfaces.

The central portion 48 has two parallel side walls 54 that extend between the two end portions, the front edges of which side walls at least butt firmly against the hypotenuse surface 18 of the sander block 10 in position in the attachment body, and can even press into the surface, thereby establishing between the side walls, the central portion and the block surface a rectangular air-tight, air-receiving plenum chamber. 56. As will be seen from FIG. 2, the block surface 18 is much wider than the width of the attachment body, so that there is no possibility of contact of any part of the rigid attachment body with the walls 42. It will be seen that once again advantage is taken of the particular nature of the sanding block material to provide a simple, lightweight vacuum assembly, in that the block provides one wall of the plenum chamber and, because of its resilience, will seal the junctions between itself and the other chamber walls.

The end portions 50 have what are described conveniently as connected edges at their junctions with the central portion 48 and the side walls 54, while the remainder of their edges, indicated by the references 58 are referred to as free edges. The end portions are hollow so as to provide therein respective air flow passages 60 connecting the free edges with the plenum chamber interior 56, so that air flow through the passages, as indicated by the series of arrows 62, can entrain dust produced by sanding adjacent the end portion free edges and convey it into the plenum chamber interior. In this embodiment each hollow end portion interior is provided with a plurality of parallel partitions 64 dividing the interior into a corresponding number of parallel channels. As will be seen from FIGS. 2 and 3, the end portions 50 are of smaller area than the respective sander block end surfaces 12 which they engage, so that the block end surfaces protrude beyond the respective free edges 58, ensuring that there is no possibility of damaging contact between these edges and the wall surfaces.

The dust-laden air passes from the plenum chamber through an opening 66, through which the connecting rod 22 also extends, the opening being relatively large to accommodate transverse movements of the rod as the tool is used. The air then passes through openings 68 in the handle to a coaxial cylindrical passage 70 in its interior. The handle is provided at the end of the interior passage with a female thread 72, or other suitable connection means, permitting the attachment directly to the handle of a hose 74 (FIG. 2) connected to a vacuum source (not shown), or the attachment of the handle extension 44, to which the vacuum hose is then connected. An air-tight connection between the plenum chamber 56 and the handle interior passage 70 is provided by a flexible bellows 76 that has one end fastened to a flange 78 surrounding the opening 66, and the other end fastened to the circumference of a two-part rigid annular sealing disc 80 mounted on a part-spherical portion 82 of the handle. The inner circumference of the disc is also part spherical and is close freely sliding fit on the handle portion 82, an O-ring 84 ensuring that the connection is sufficiently air-tight. The two butting annular parts of the disc are connected together by screws 86 permitting the disc to be readily assembled and disassembled when required. Such a flexible mechanical connection ensures that the handle can be manipulated freely without disrupting the flow of air through the assembly.

It will be seen that attachment assemblies in accordance with the invention can readily be manufactured inexpensively to be of the desired light weight, in that it comprises essentially only a few parts, namely the attachment body 46, the bellows 76, and the sealing disc 80, all of which can be fabricated from low density plastics materials. The vacuum source can comprise any one of the many standard vacuum sources that are already available. The modification required to the handle is relatively simple, in that most such handles are already provided with a connection thread 72 for an extension handle. The manner in which the assembly employs the sander block as an essential element of the combination ensures that it can easily be replaced as and when necessary, when the abrasive material is worn or the grade of abrasive material is to be changed.

Although in this preferred embodiment the handle and vacuum connection are coaxial this is not necessary, and in other embodiments the vacuum hose may be connected to its own opening from the plenum chambers; the handle will still require a flexible air-tight member to close the hole through which it passes, and preferably the vacuum hose is then attached along its length to the handle so that its weight does not drag on the assembly. An alternative to the rigid two-part disc is a solid annular disc of a flexible plastics material fastened at its inner and outer circumferences respectively to the handle and the bellows 76, the body of the disc flexing to accommodate the relative movements of the handle and the bellows.

I claim:

1. A combination of a corner sanding tool and a vacuum attachment assembly therefor, the corner sanding tool employing a replaceable sander block of resilient foam material;

the sander block having a transverse cross section of the form of an isosceles triangle, two end surfaces of correspondingly isosceles triangular shape, two equal rectangular sanding side surfaces coated with abrasive material, and a rectangular hypotenuse side surface;

the corner sanding tool comprising handle means attachable to and detachable from the sander block for its manipulation to carry out a sanding operation;

the handle means comprising a carrier member having a transverse cross section of the form of an isosceles triangle and a handle pivotally connected to the carrier member;

the sander block having a chamber therein opening to the hypotenuse side surface and shaped to snugly receive the carrier member and thereby operatively connect the handle means and the sander block together;

the vacuum attachment assembly comprising an attachment body having a central portion and two parallel end portions each extending at a right angle from a respective end of the central portion;

the length of the central portion in relation to the corresponding length of the sander block being such that with a sander block in position in the assembly the assembly end portions and the block end surfaces are engaged with one another under the urge of the resilient sander block material to retain the attachment body securely on the block, whereby the vacuum assembly is supported by the sander block on the corner sanding tool;

the central portion having two parallel side walls extending between the two end portions which are butted by the hypotenuse surface of a sander block in position in the attachment body to thereby establish an air-receiving plenum chamber between the side walls, the central portion and the block hypotenuse surface;

the end portions having respective connected edges at their junctions with the central portion and the side walls, and at least portions of the remainder of their edges being free edges adjacent to sander block sanding surfaces;

the attachment body end portions being of smaller area than the respective sander block end surfaces which they engage, so that the end surfaces protrude beyond the respective free edges of the end portions;

the end portions having therein air flow passages connecting the free edges with the plenum chamber interior, whereby air flow through the passages can entrain dust produced by sanding adjacent the end portion free edges and convey it into the plenum chamber interior;

the central portion having therein at least one opening from the plenum chamber to permit passage therefrom of air and entrained dust, and to permit extension of the handle freely through the attachment body to the carrier member.

2. An assembly as claimed in claim 1, wherein the attachment body end portions are of triangular shape in plan and their free edges are uniformly spaced from the corresponding sander block edges.

3. An assembly as claimed in claim 1, wherein each attachment body end portion has a plurality of parallel air passages extending from its free edges to the plenum chamber interior.

4. An assembly as claimed in claim 1, wherein the handle is hollow and constitutes at least part of the passage through which the air and entrained dust passes from the plenum chamber.

5. An assembly as claimed in claim 3, wherein the attachment body central portion has a single opening therein through which both the handle and the air passage extend;

and comprising a flexible air-tight sleeve surrounding the handle into which the opening discharges and through which the handle passes, the air passing from the interior of the sleeve into the portion of the air passage within the handle.

6. An assembly as claimed in claim 4, wherein a spherical mechanical joint is provided between the handle and the flexible sleeve.

7. An assembly as claimed in claim 1, wherein the butting surfaces of the attachment body end portions and the block end surfaces have friction sheet material interposed between them to increase the retaining friction between them.

8. A combination of a sanding tool and a vacuum attachment assembly therefor, the sanding tool employing a replaceable sander block of resilient foam material having two end surfaces, at least one sanding side surface coated with abrasive material, and a back side surface;

the corner sanding tool comprising handle means attachable to and detachable from the sander block for its manipulation to carry out a sanding operation;

the handle means comprising a carrier member and a handle pivotally connected to the carrier member;

the sander block having a chamber therein opening to the back side surface and shaped to snugly receive the carrier member and thereby operatively connect the handle means and the sander block together;

the vacuum attachment assembly comprising an attachment body having a central portion and two parallel end portions each extending at a right angle from a respective end of the central portion;

the length of the central portion in relation to the corresponding length of the sander block being such that with a sander block in position in the assembly the assembly end portions and the block end surfaces are engaged with one another under the urge of the resilient sander block material to retain the attachment body securely on the block, whereby the vacuum assembly is supported by the sander block on the corner sanding tool;

the central portion having two parallel side walls extending between the two end portions which are butted by the back side surface of a sander block in position in the attachment body to thereby establish an air-receiving plenum chamber between the side walls, the central portion and the block back side surface;

the end portions having respective connected edges at their junctions with the central portion and the side walls, and at least portions of the remainder of their edges being free edges adjacent to the sander block sanding surface;

the attachment body end portions being of smaller area than the respective sander block end surfaces which they engage, so that the end surfaces protrude beyond the respective free edges of the end portions;

the end portions having therein air flow passages connecting the free edges with the plenum chamber interior, whereby air flow through the passages can entrain dust produced by sanding adjacent the end portion free edges and convey it into the plenum chamber interior;

the central portion having therein at least one opening from the plenum chamber to permit passage therefrom of air and entrained dust, and to permit extension of the handle freely through the attachment body to the carrier member.

9. An assembly as claimed in claim 8, wherein the free edges of the attachment body end portions are uniformly spaced from the corresponding sander block edges.

10. An assembly as claimed in claim 8, wherein each attachment body end portion has a plurality of parallel air passages extending from its free edges to the plenum chamber interior.

11. An assembly as claimed in claim 8, wherein the handle is hollow and constitutes at least part of the passage through which the air and entrained dust passes from the plenum chamber.

12. An assembly as claimed in claim 11, wherein the attachment body central portion has a single opening therein through which both the handle and the air passage extend;

and comprising a flexible air-tight sleeve surrounding the handle into which the opening discharges and through which the handle passes, the air passing from the interior of the sleeve into the portion of the air passage within the handle.

13. An assembly as claimed in claim 12, wherein a spherical mechanical joint is provided between the handle and the flexible sleeve.

14. An assembly as claimed in claim 8, wherein the butting surfaces of the attachment body end portions and the block end surfaces have friction sheet material interposed between them to increase the retaining friction between them.

* * * * *